US005951858A

United States Patent [19]

Soto et al.

[11] Patent Number: 5,951,858

[45] Date of Patent: Sep. 14, 1999

[54] DEVICE FOR CLEANING THE SURFACE OF THE BODY OF WATER IN A POOL

[76] Inventors: Eduardo Soto, Capital Bank Building 2151 Lejeune Rd., Coral Gables, Fla. 33134; Jorge Izquierdo, 6390 W. 22 Ct., #104, Hialeah, Fla. 33016

[21] Appl. No.: 09/082,131

[22] Filed: May 20, 1998

[51] Int. Cl.[6] ..... E04H 4/16

[52] U.S. Cl. ..... 210/169; 210/232; 210/238; 210/242.1; 4/496

[58] Field of Search ..... 210/154, 169, 210/170, 232, 236, 238, 241, 242.1, 470, 483, 497.01; 4/490, 496; 15/1.7

[56] References Cited

U.S. PATENT DOCUMENTS

| | | |
|---|---|---|
| 3,188,668 | 6/1965 | Buckelew . |
| 3,863,237 | 1/1975 | Doerr . |
| 4,169,331 | 10/1979 | Baker . |
| 4,237,645 | 12/1980 | Kinser . |
| 4,324,015 | 4/1982 | Head . |
| 4,822,487 | 4/1989 | Soich . |
| 5,139,660 | 8/1992 | Lourie et al. . |
| 5,223,135 | 6/1993 | MacPhee et al. . |
| 5,276,989 | 1/1994 | Lumb et al. . |
| 5,422,001 | 6/1995 | Yagoda et al. . |
| 5,705,058 | 1/1998 | Fischer . |
| 5,849,184 | 12/1998 | Veillet . |

*Primary Examiner*—Jay H. Woo
*Assistant Examiner*—Fred Prince
*Attorney, Agent, or Firm*—J. Sanchelima

[57] ABSTRACT

A device for cleaning a body of water by passing an elongated net having a C-shaped cross section over the surface and slightly immersed in the water. The elongated net is supported by elongated rigid members that include C-shape brackets that are cooperatively disposed therealong. A rubber band with cooperating slots is positioned over the arcuated plate of the brackets trapping the elongated net in place. An upright wheeled assembly is perpendicularly mounted to the elongated net and includes a mechanism for adjusting the vertical position of the net. The upright wheeled assembly includes a cooperatively positioned handle for imparting motion to the structure.

8 Claims, 2 Drawing Sheets

DEVICE FOR CLEANING THE SURFACE OF THE BODY OF WATER IN A POOL

BACKGROUND OF THE INVENTION

1. Field of the Invention

The present invention relates to a device for cleaning the surface of the body of water.

2. Description of the Related Art

Cleaning pools is a tedious task that requires the periodic use of cleaning devices that vary in complexity from a simple net to fish out debris to more elaborate pumps and filters. These devices typically concentrate in areas of the body of water requiring considerable time. Most of the debris, however, floats and can be readily removed with the present invention. There are no devices at present that perform this task of cleaning the surface of a body of water, such as a pool or fountain.

Applicant believes that the closest reference corresponds to U.S. Pat. No. 5,422,001 issued to Yagoda for an enlarged pool skimmer with a buoyancy component. However, it differs from the present invention because it lacks the wheeled assembly that characterizes the present invention, among other features. Also, Yagoda's patented invention is designed to be immersed substantially in the body of water, with the consequent larger dimensions and weight.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a simple device for cleaning the surface of a stationary body of water, such as a pool or fountain, and that requires a minimum of effort so that it can be used by practically anyone in an average household.

It is another object of this invention to provide a cleaning device that is light weight and can be readily adjusted to the contour of the body of water to be used on.

It is another object of this invention to provide a cleaning device that permits a user to easily clean the whole surface of the contained water with only one journey in one direction along the length of the pool thus minimizing time and effort.

It is still another object of the present invention to provide a cleaning device that withstands the action of the elements.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
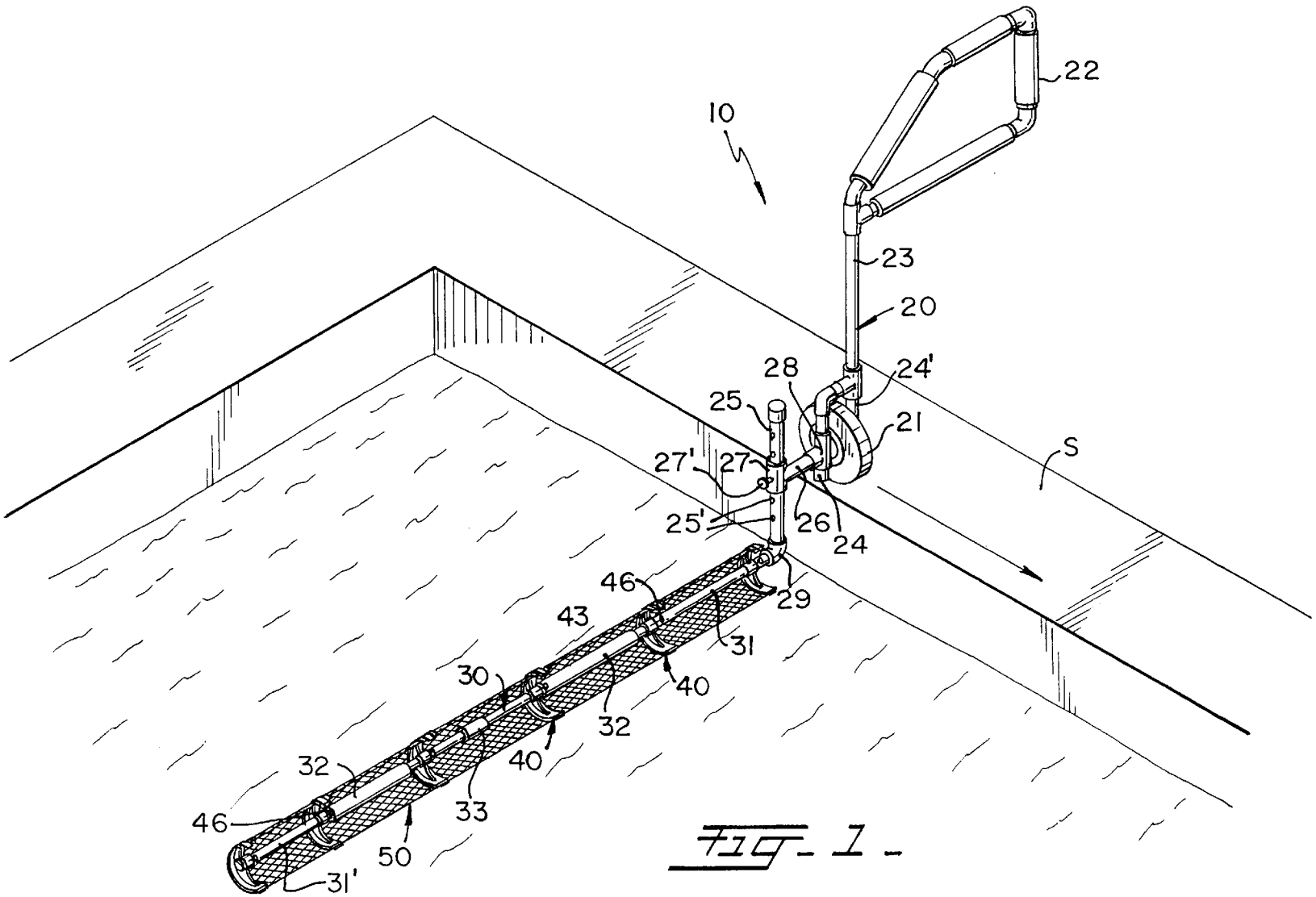
FIG. 1 is an isometric view from the top of the present invention. This illustration shows one application of this invention cleaning the surface of the body of water of a pool.

Referring now to the drawings, where the present invention is generally referred to with numeral 10, it can be observed that it basically includes wheeled upright assembly 20 and floating elongated assembly 30 mounted substantially perpendicularly to assembly 20. Assembly 20 includes wheel 21 mounted thereon and handle 22. Upright assembly 20 is removably mounted to floating elongated assembly 30 that is cooperatively positioned with respect to a body of water to collect the floating debris.

As illustrated in FIG. 1, upright assembly 20 includes handle 22 mounted to the uppermost end of upright elongated tubular member 23 extending a convenient distance to be comfortably within the reach of the user. Fork members 24 and 24' are mounted to the other end of member 23. Handle 22 permits a user to readily manipulate cleaning device 10, typically by pushing it along the peripheral edge of the body of water to be cleaned, such as a pool or fountain. Wheel 21 is rotably mounted between fork members 24 and 24', in the preferred embodiment. Upright assembly 20 also includes tubular supporting members 25 and 26 that in combination with member 23 comprise the structure of assembly 20. Tubular member 26, in the preferred embodiment, have tubular end 27, at one end, and coupling 28 at the other end. Tubular end 27 has an opening through which screw member 27' passes. Supporting member 25 includes openings 25' so that the former can be telescopically adjusted with tubular end 27 and screw member 27'. This permits a user to adjust the desire height of assemblies 20 and 30 with respect to resting surface S.

Floating elongated assembly 30 is removably mounted to tubular supporting member 26 by coupler member 29 and floats in the surface of water aided by floating foam members 32. Floating elongated assembly 30, includes elongated tubular member 31 mounted at one end to coupler member 29. Floating elongated assembly 30 includes a plurality of brackets 40 slidably mounted to elongated tubular member 31. Brackets 40 are placed equidistant to each other and are designed to hold net 50. A plurality of elongated tubular members 31 can be mounted to each other depending on the needs. FIG. 1 shows elongated tubular members 31 and 31' interconnected with connector member 33.

Figure 2:
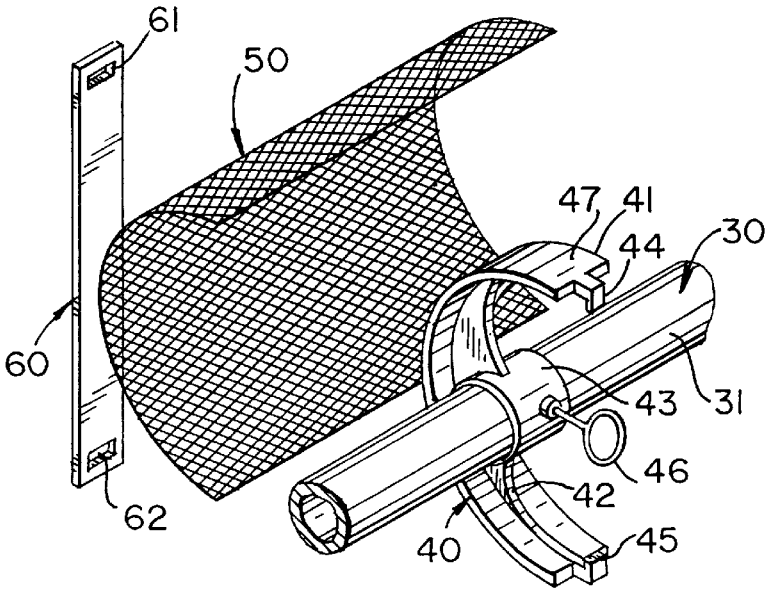
FIG. 2 is a partial isometric view of an elongated floating member with a bracket mounted thereto and showing a net and holding band in exploded.
Figure 3:
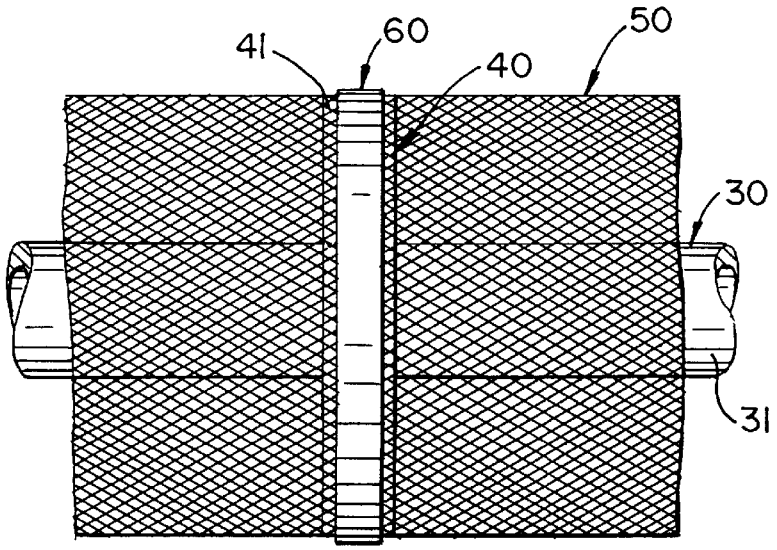
FIG. 3 is an elevational rear view of the parts shown in the previous figure.

As illustrated in FIGS. 2 and 3, bracket 40 is mounted to elongated tubular member 31 through tubular member 43. Bracket 40, in the preferred embodiment, basically comprises arcuated or C-shaped plate 41, half-moon rib 42 and tubular member 43 that is rigidly mounted to the central portion of half-moon rib 42. Half-moon rib 42 is located along the central line of plate 41 and is designed to provide strength to the structure of bracket 40. Arcuated plate 41 is immersed slightly below the surface of the body of water when device 10 is being used. Arcuated plate 41 includes, at its ends, tabs 44 and 45. Tabs 44 and 45 are intended to be cooperatively received within slots 61 and 62 of rubber band 60, as shown in FIG. 2. Brackets 40 are slidably mounted on elongated tubular member 31 and secured at predetermined locations with screw members 46, net 50 is placed over outer surface 47 of plate 41. Then, rubber band 60 is placed over net 50 maintaining the latter in place over surface 47, as best seen in FIGS. 2 and 3. Net 50, in the preferred embodiment, forms an elongated C-shaped trough substantially co-extensive with tubular members 31 and 31', as best seen in FIG. 1. Net 50 is designed to collect the floating debris found in the surface of the body of water when slightly immersed.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A device for cleaning the surface of a body of water, comprising:

A) a wheeled upright assembly including an elongated rigid member with first and second ends and handle means mounted to said first end to permit a user to push said upright assembly;

B) elongated supporting means mounted substantially perpendicularly to said wheeled upright assembly wherein said elongated supporting means float; and C) an elongated net member having a corresponding elongated lower portion and being perpendicularly mounted to said elongated supporting means and also perpendicular to said upright assembly, said elongated net member has a "C" cross-section forming an elongated trough with the lower portion of said elongated net member being immersed slightly below said surface so that floating debris is collected within said trough as elongated supporting means is moved over said body of water.

2. The device set forth in claim 1 further including:

D) means for adjusting the vertical position of said elongated net member.

3. The device set forth in claim 2 wherein said elongated supporting means includes a plurality of bracket assemblies mounted thereon, and each of said bracket assemblies including an arcuated plate over which said elongated net member is mounted, and further including means for fastening said elongated net member to said arcuated plate.

4. The device set forth in claim 3 wherein said means for fastening includes at least two tabs on said arcuated plate and a rubber band with cooperatively positioned slots to receive said tabs thereby keeping said elongated net member trapped inbetween.

5. The device set forth in claim 4 wherein said wheeled upright assembly includes a telescopically adjustable support member having third and fourth ends, said third end being perpendicularly mounted to said elongated supporting means, said telescopically adjustable support member being at a parallel and spaced apart relationship with respect to said elongated rigid member.

6. The device set forth in claim 5 wherein said elongated rigid member, elongated supporting means and telescopically adjustable support member are tubular.

7. The device set forth in claim 6 further including a plurality of floating members mounted to said elongated supporting means so that the lower half of said elongated net member is immersed slightly below said surface.

8. The device set forth in claim 7 wherein said elongated supporting means includes a plurality of sections and connector members so that the length can be adjusted to the requirements of said body of water.

* * * * *